US007857576B2

(12) United States Patent
Durocher et al.

(10) Patent No.: US 7,857,576 B2
(45) Date of Patent: Dec. 28, 2010

(54) SEAL SYSTEM FOR AN INTERTURBINE DUCT WITHIN A GAS TURBINE ENGINE

(75) Inventors: Eric Durocher, Vercheres (CA); Rene Paquet, Montréal (CA)

(73) Assignee: Pratt & Whitney Canada Corp., Longueuil, Québec (CA)

( * ) Notice: Subject to any disclaimer, the term of this patent is extended or adjusted under 35 U.S.C. 154(b) by 949 days.

(21) Appl. No.: 11/530,504

(22) Filed: Sep. 11, 2006

(65) Prior Publication Data

US 2008/0063514 A1 Mar. 13, 2008

(51) Int. Cl.
*F01D 11/00* (2006.01)
*F01D 25/26* (2006.01)

(52) U.S. Cl. ..... 415/1; 415/135; 415/136; 415/214.1; 60/799; 277/641; 277/630; 277/910

(58) Field of Classification Search ..... 415/135, 415/136, 138, 139, 170.1, 174.2, 214.1, 1, 415/209.2–209.4, 210.1; 60/752, 799, 800, 60/805; 277/572, 576, 577, 637, 641, 630, 277/910

See application file for complete search history.

(56) References Cited

U.S. PATENT DOCUMENTS

| | | | | |
|---|---|---|---|---|
| 4,331,338 | A * | 5/1982 | Caldwell et al. | 277/606 |
| 5,330,321 | A * | 7/1994 | Roberts et al. | 415/136 |
| 2006/0045732 | A1 | 3/2006 | Durocher et al. | |
| 2007/0160471 | A1 * | 7/2007 | Welch | 415/214.1 |

* cited by examiner

*Primary Examiner*—Christopher Verdier

(74) *Attorney, Agent, or Firm*—Ogilvy Renault LLP

(57) ABSTRACT

The interturbine duct (ITD) directs hot combustion gases from a high pressure turbine stage outlet to a low pressure turbine stage inlet in a gas turbine engine. The ITD comprises an outer wall and a heat resistant non-metallic resilient annular seal provided around an end of the outer wall that is adjacent to the high pressure turbine stage outlet.

4 Claims, 2 Drawing Sheets

SEAL SYSTEM FOR AN INTERTURBINE DUCT WITHIN A GAS TURBINE ENGINE

TECHNICAL FIELD

The invention relates generally to a seal system for an interturbine duct (ITD) within a gas turbine engine.

BACKGROUND

Interturbine ducts (ITD) are used for channelling hot combustion gases between adjacent turbine stages. ITDs include a generally conical inner wall and a generally conical outer wall between which the hot combustion gases flow. The outer wall is adjacent to the interior of a turbine casing in which the ITD is provided.

Because of thermal expansion, the upstream end of the ITD is generally not attached directly to the turbine casing. The outer wall of the ITD may have an outwardly extending flange with a free end that is very close to the interior of the turbine casing. The expansion caused by intense heat and pressure during operation of the engine generally seals the space between the ITD and the interior of the turbine casing so as to prevent a combustion gas ingestion.

While the above-described arrangement has proved to be satisfactory for most applications, engines with relatively cooler combustion gases and which generate less pressure inside the ITD may require another approach. Overall, it was thus a need to provide an improved seal system for an interturbine duct within a gas turbine engine.

SUMMARY

In one aspect, the present concept provides an interturbine duct (ITD) adapted to direct hot combustion gases from a high pressure turbine stage outlet to a low pressure turbine stage inlet in a gas turbine engine, the ITD comprising an outer wall and a heat-resistant non-metallic resilient annular seal provided around an end of the outer wall that is adjacent to the high pressure turbine stage outlet.

In a second aspect, the present concept provides a seal system for an interturbine duct (ITD) within a gas turbine engine, the ITD having an upstream end with reference to a gas path within the engine, the system comprising: an annular seal, the seal being made of a resilient heat-resistant non-metallic material; and an annular seal holder to be rigidly connected to an outer surface of the upstream end of the ITD.

In a third aspect, the present concept provides a method of sealing an annular space between an upstream end of an interturbine duct (ITD) and a turbine casing surrounding the ITD within a gas turbine engine, the method comprising: interposing a resilient non-metallic annular seal between an external surface of the upstream end of the ITD and an internal surface of the turbine casing; and operating the gas turbine engine to expand the upstream end and increase a sealing engagement between the annular seal and the internal surface of the turbine casing.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION

Figure 1:
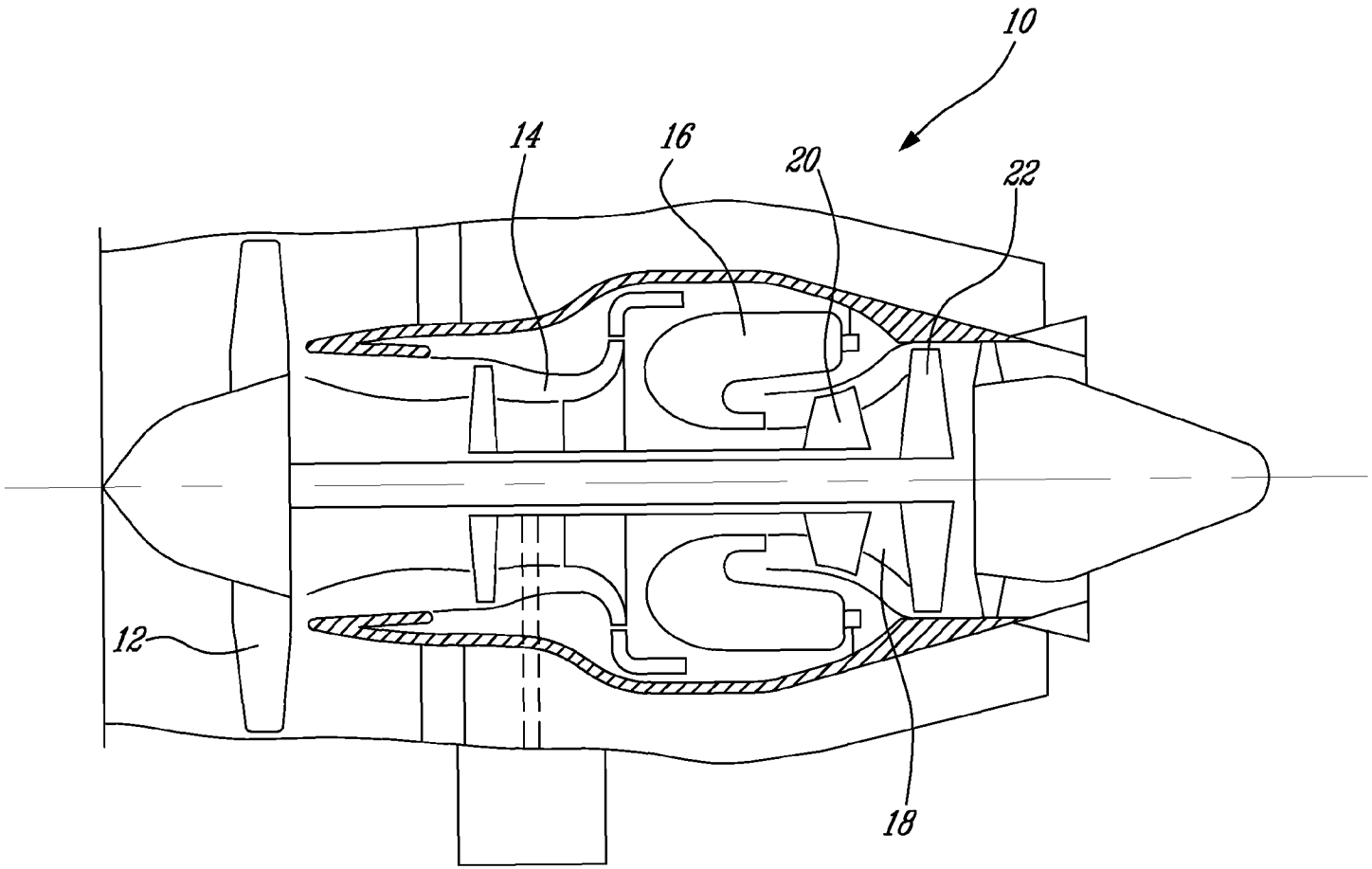
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases. In this example, the turbine section 18 includes a high pressure turbine stage (HPT) 20 and a low pressure turbine stage (LPT) 22.

Figure 2:
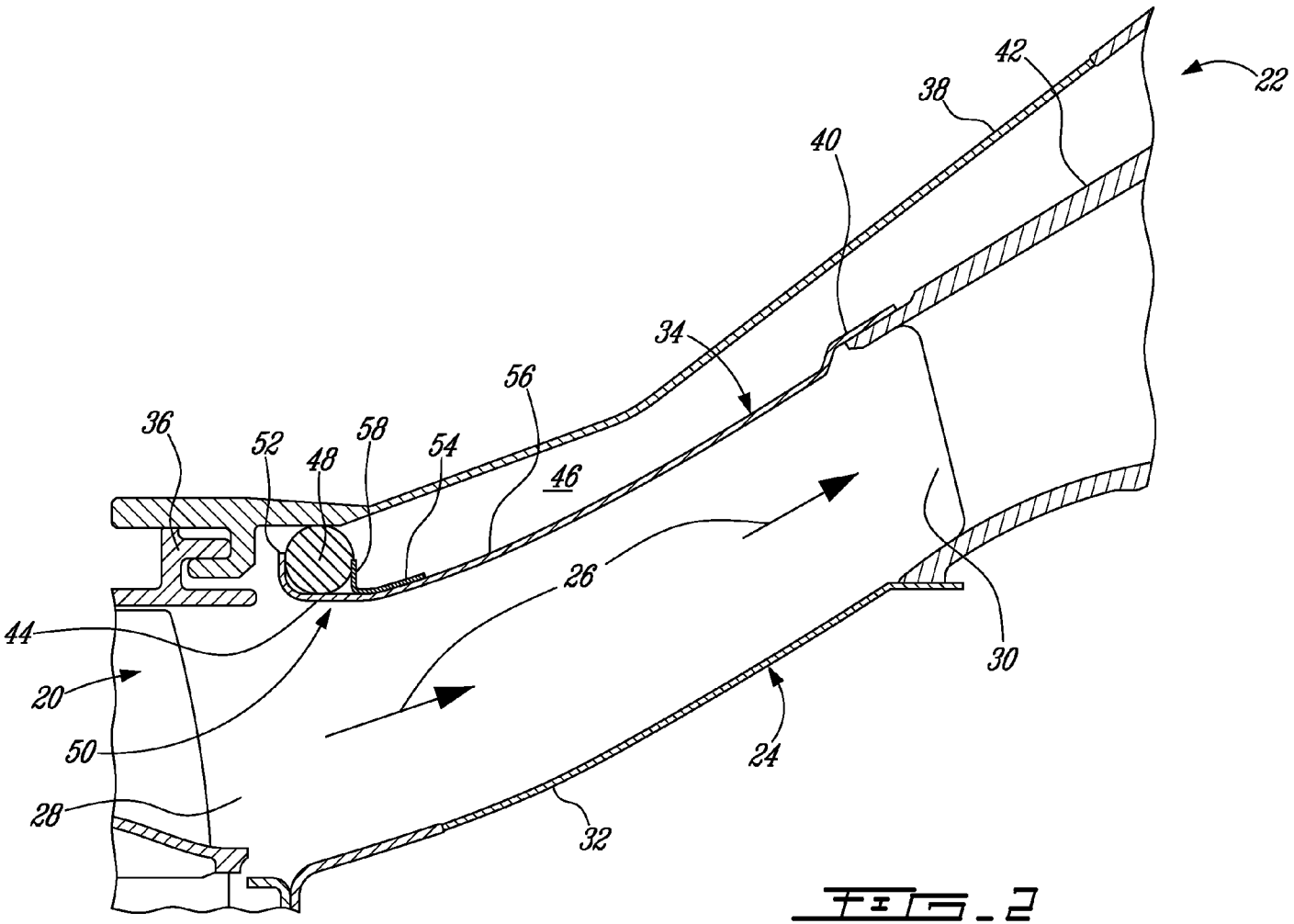
FIG. 2 is a schematic longitudinal cross-sectional view of an improved interturbine duct.

FIG. 2 shows an example of an improved interturbine duct 24 (ITD). The ITD 24 delimits a gas path 26 between the HPT outlet 28 and LPT inlet 30. The ITD 24 has an inner wall 32 and an outer wall 34. In this example, the HPT shroud 36 is connected to the LPT shroud (not shown) by a turbine casing 38 which surrounds the outer wall 34. The outer wall 34 has a downstream end 40 connected to the LPT stator vane ring 42, and has an upstream end 44 adjacent the HPT shroud 36. An interspace 46 is provided between the outer wall 34 and the turbine casing 38. In this example, the outer wall 34 is made of a sheet material such as sheet metal.

An annular seal 48 is provided around the upstream end 44 of the outer wall 34. The annular seal 48 serves to restrict the ingestion of hot combustion gases into the interspace 46. The annular seal 48 is made of a resilient heat-resistant non-metallic packing, such as, braided ceramic fiber with an optional sheath made from cobalt or nickel alloy. The annular seal 48 can have a round cross section, with an outside diameter of 0.250 inch, for instance.

The outer wall 34 may include an annular seal holder 50 to restrict the longitudinal displacement of the annular seal 48 along the outer wall 34. The upstream end 44 of the outer wall 34 has a flange 52 oriented radially outwardly and forming a first part of the annular seal holder 50. The annular seal holder 50 may include a bracket 54 rigidly connected to the outer surface 56 of the outer wall 34 and having a second flange 58, parallel to and adjacent to the first flange 52, the second flange 58 forming the second part of the annular seal holder 50. The bracket 54 has a substantially L-shaped cross section. The annular seal 48 is thus positioned between the first flange 52 and the second flange 58, and is thereby restrained from longitudinal displacement along the outer wall 34. Alternately, the second flange 58 can be provided in the turbine casing 38.

During operation of the gas turbine engine 10, heat and pressure increase within the ITD 24. This generates a force which pushes the outer wall 34 toward the turbine casing 38. This results in compressing the annular seal 48 and contributing to the sealing engagement.

The above description is meant to be exemplary only, and one skilled in the art will recognize that changes may be made to the embodiments described without departing from the scope of the invention disclosed. For example, the annular seal can be used with other types of ITDs than the one illustrated herein. Other types of annular seal holders can be used to maintain the longitudinal position of the annular seal. For example, the second flange can be radially inwardly-oriented and be provided on the turbine casing rather than on the outer wall. Further, the seal holder is optional since certain turbine casing and ITD configurations may limit the longitudinal displacement of the annular seal without the use of an additional seal holder. Several such alternate configurations for retaining the annular seal will be readily devised by those skilled in the art given the teachings of the present description. Still other modifications which fall within the scope of the present invention will be apparent to those skilled in the art, in light of a review of this disclosure, and such modifications are intended to fall within the appended claims.

What is claimed is:

1. An interturbine duct (ITD) adapted to direct hot combustion gases from a high pressure turbine stage outlet to a low pressure turbine stage inlet in a gas turbine engine, the ITD comprising:

an outer wall having:

an upstream end positioned adjacent to the high pressure turbine stage outlet and downstream of a trailing edge of rotor blades of the high pressure turbine stage outlet, and a downstream end secured directly to a stator vane ring to define a gas path for hot combustion gases exiting the high pressure turbine stage outlet; and a heat-resistant non-metallic resilient annular seal provided around the upstream end of the outer wall and in contact with a turbine support case to seal off the upstream end of the ITD.

2. The ITD as defined in claim 1 wherein the outer wall is made of sheet material and has a radially outwardly oriented flange at the end, the ITD further comprising an annular seal-holding bracket rigidly connected to the outer wall adjacent to the flange and cooperating with the flange to form an annular seal holder.

3. A seal system for an interturbine duct (ITD) within a gas turbine engine, the ITD having an upstream end with reference to a gas path within the engine, the system comprising:

an annular seal, the seal being made of a resilient heat-resistant non-metallic material; and an annular seal holder to be rigidly connected to an outer surface of the upstream end of the ITD, the seal holder including a first flange formed at the upstream end of an outer wall of the ITD and a bracket with an L-shaped cross section, the bracket being connected to the outer surface of the upstream end of the ITD with a second flange parallel to and adjacent to the first flange.

4. A method of sealing an annular space between an upstream end of an interturbine duct (ITD) and a turbine casing surrounding the ITD within a gas turbine engine, the method comprising:

positioning an outer wall in the turbine casing such that the upstream end of the wall is adjacent to a high pressure turbine stage outlet and downstream of a trailing edge of rotor blades of the high pressure turbine stage outlet;

securing a downstream end of the outer wall directly to a stator vane ring to define a gas path for hot combustion gases exiting the high pressure turbine stage outlet;

interposing a resilient non-metallic annular seal between an external surface of the upstream end of the ITD and an internal surface of the turbine casing; and operating the gas turbine engine to expand the upstream end and increase a sealing engagement between the annular seal and the internal surface of the turbine casing.

* * * * *